US009345940B2

(12) United States Patent
Chiu

(10) Patent No.: US 9,345,940 B2
(45) Date of Patent: May 24, 2016

(54) MULTIFUNCTIONAL SWAYING THROWING GAME APPARATUS

(71) Applicant: Yen-Po Chiu, Taipei (TW)

(72) Inventor: Yen-Po Chiu, Taipei (TW)

( * ) Notice: Subject to any disclaimer, the term of this patent is extended or adjusted under 35 U.S.C. 154(b) by 0 days.

(21) Appl. No.: 14/470,087

(22) Filed: Aug. 27, 2014

(65) Prior Publication Data

US 2016/0059099 A1 Mar. 3, 2016

(51) Int. Cl.
*A63B 63/00* (2006.01)
*A63B 63/06* (2006.01)
*A63B 67/06* (2006.01)

(52) U.S. Cl.
CPC ..... *A63B 63/06* (2013.01); *A63B 67/06* (2013.01); *A63B 63/00* (2013.01); *A63B 2067/063* (2013.01)

(58) Field of Classification Search
CPC ..... A63B 67/06; A63B 2071/026; A63B 2067/063; A63H 15/06; A63F 2009/0213
USPC ..... 273/369, 336, 338, 339, 407; 473/447
See application file for complete search history.

(56) References Cited

U.S. PATENT DOCUMENTS 1,617,127 A * 2/1927 Levay ..... A63F 9/0243 273/339
1,630,137 A * 5/1927 Ruwwe ..... A63H 15/06 446/325
2,009,625 A * 7/1935 Knorpp ..... A63F 9/0208 273/336
2,458,306 A * 1/1949 Schneider ..... A63F 9/26 273/450
3,421,762 A * 1/1969 Paradise ..... A63F 9/0208 211/107
3,442,045 A * 5/1969 Green ..... A63H 15/06 446/297
4,092,023 A * 5/1978 Hazen ..... A63B 63/00 273/369
6,217,408 B1 * 4/2001 Willinger ..... A01K 15/025 119/707
6,543,777 B2 * 4/2003 Carbonero ..... A63B 71/023 248/176.1
6,612,943 B2 * 9/2003 Beers ..... A63B 69/0091 473/422
6,736,738 B1 * 5/2004 Taa ..... A63B 63/008 273/402
7,905,491 B2 * 3/2011 Gray ..... A63F 9/26 273/449
2009/0156333 A1 * 6/2009 Bridge ..... A63B 69/0071 473/447

* cited by examiner

*Primary Examiner* — Mark Graham
(74) *Attorney, Agent, or Firm* — Pro-Techtor International Services; Ian Oglesby

(57) ABSTRACT

A multifunctional swaying throwing game apparatus is formed by assembling a base and a rod, in which the base is a base able to sway and rock back and forth. The rod is designed to form a Y-shaped rod, and clasp hooks and clasp holes are provided on support rods extending from the upper portion of the rod. The clasp hooks enable hook holes of rings to hook thereon, and the clasp holes enable the peripheral edge of rings to be inserted and fixed therein. The hollow part of each of the rings allows for children to throw sandbags, rubber bands, or other objects therethrough.

1 Claim, 5 Drawing Sheets

MULTIFUNCTIONAL SWAYING THROWING GAME APPARATUS

BACKGROUND OF THE INVENTION (a) Field of the Invention

The present invention relates to a game apparatus, and more particularly to a multifunctional swaying throwing game apparatus that trains throwing accuracy while the apparatus is swaying and rocking back and forth.

(b) Description of the Prior Art

General conventional game apparatus are monotonous and crude assemblies, and are all fixed structural apparatus that are unable to sway or rock back and forth. Moreover, the set of rings generally included with the apparatus only provide a single form of throwing game for the rings. Because of this, conventional game apparatus are very monotonous and crude, and are unable to arouse the interest of children. Hence, the inventor of the present invention has made significant improvements on the conventional game apparatus to provide a throwing game apparatus that sways and rocks back and forth, as well as further equipping the game apparatus with the relatively difficult games of throwing sandbags, firing paper airplanes, firing rubber bands, and the like, through rings on the game apparatus.

SUMMARY OF THE INVENTION

The primary objective of the present invention is to provide a multifunctional swaying throwing game apparatus, which comprises a base that is able to sway and rock back and forth, and a Y-shaped rod that is positioned on the upper side of the base. Clasp hooks and clasp holes provided on the rod are used to securely hold various forms of throwing rings, thereby providing children with various throwing games including throwing sandbags, firing rubber bands, throwing paper airplanes, or other objects through the hollow parts of the rings.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
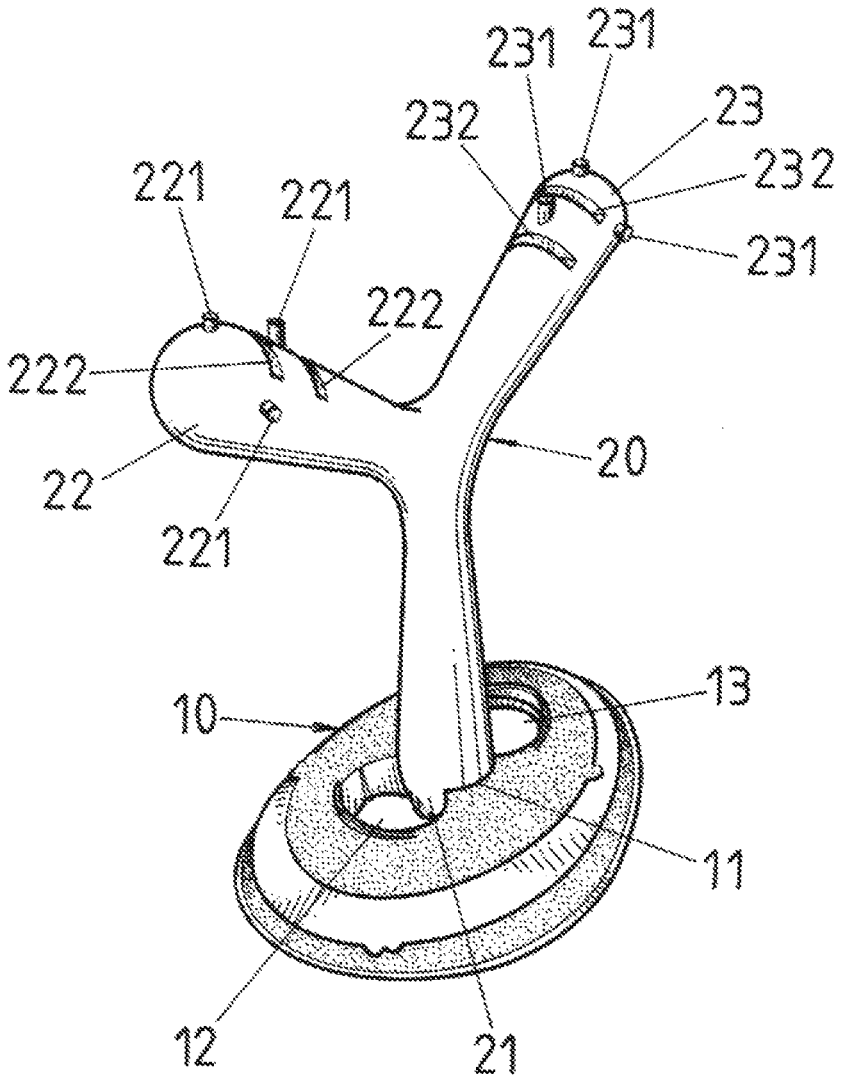
FIG. 1 shows a schematic view of the present invention.
Figure 2:
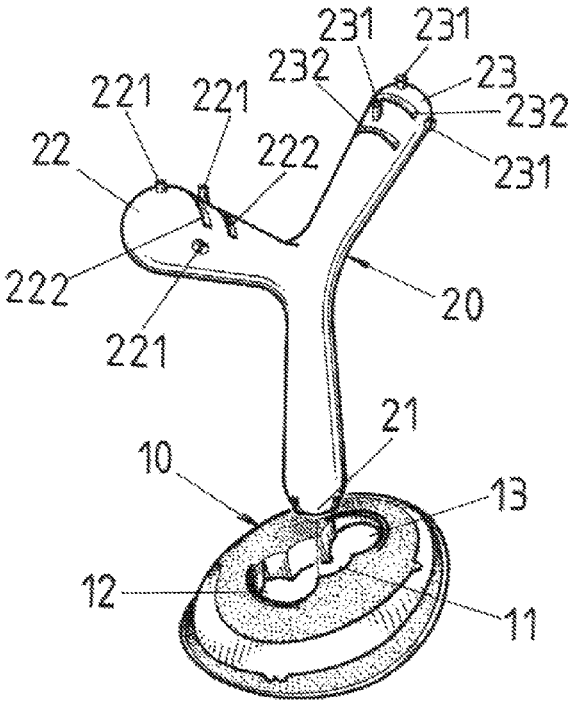
FIG. 2 shows an exploded view of the present invention.

Referring to FIG. 1 and FIG. 2. a multifunctional swaying throwing game apparatus of the present invention comprises a base 10 and a rod 20, wherein the base 10 is a base that is able to sway and rock back and forth, The front and rear positions of the base 10 are lower so as to be in contact with the horizontal surface of a floor or table, whereas the left and right side positions of the base 10 are higher and off the ground, with a space between the left and right side positions and the horizontal surface of a floor or table. The surface of the base 10 is provided with at least one clasp groove 11. The left and right sides of the clasp groove 11 respectively link up with clasp grooves 12, 13 so as to provide three clasp grooves 11, 12, and 13 that form an integral arc-shaped wavy slotted hole.

Figure 3:
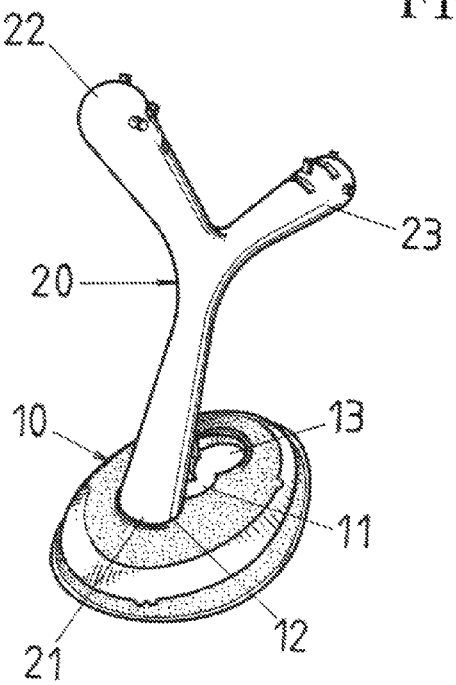
FIG. 3 shows another schematic view of the present invention.
Figure 4:
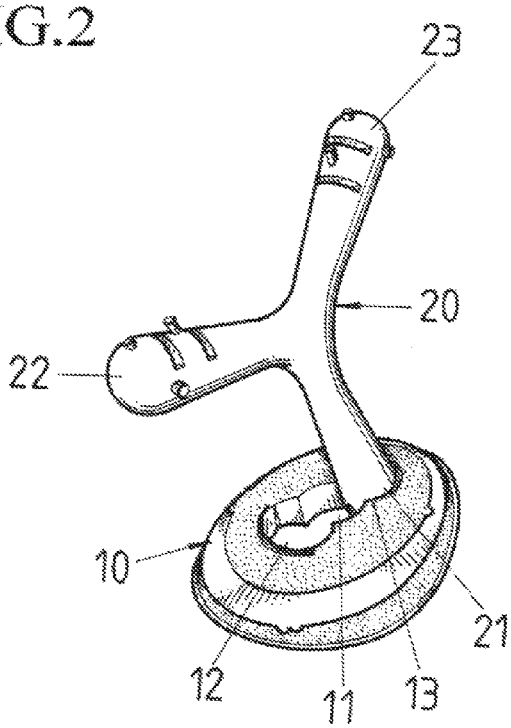
FIG. 4 shows another schematic view of the present invention.

The rod 20 is designed to form a Y-shaped rod, with the rod 20 extending in three directions from a supporting point in the center thereof to form three support rods 21, 22, and 23. The support rods 21, 22, 23 gradually expand from the central supporting point into molded shapes that transform from being narrow at the supporting point to wide at the ends. The bottom support rod 21 is wedged into the clasp groove 11 in the middle of the base 10 (as shown in FIG. 1), or wedged into one of the clasp grooves 12, 13 in the left and right sides of the base 10 respectively (as shown in FIG. 3 and FIG. 4). When the rod 20 is wedged inside the clasp groove 11 in the middle of the base 10, the base 10 assumes a scale-shaped swaying mode. When the rod 20 is wedged inside one of the clasp grooves 12, 13 in the left and right sides of the base 10, the base 10 leans toward one side.

Figure 5:
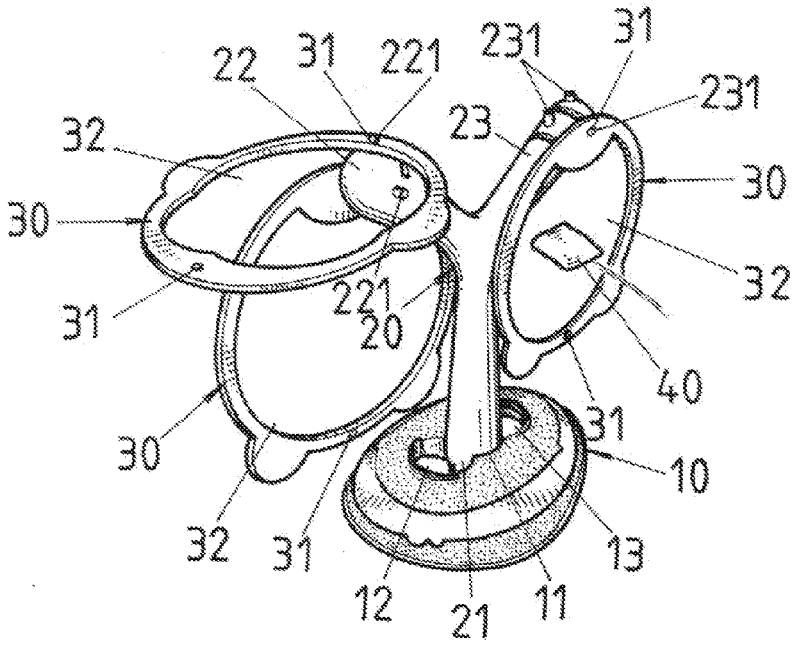
FIG. 5 shows a schematic view of an embodiment of the present invention.
Figure 6:
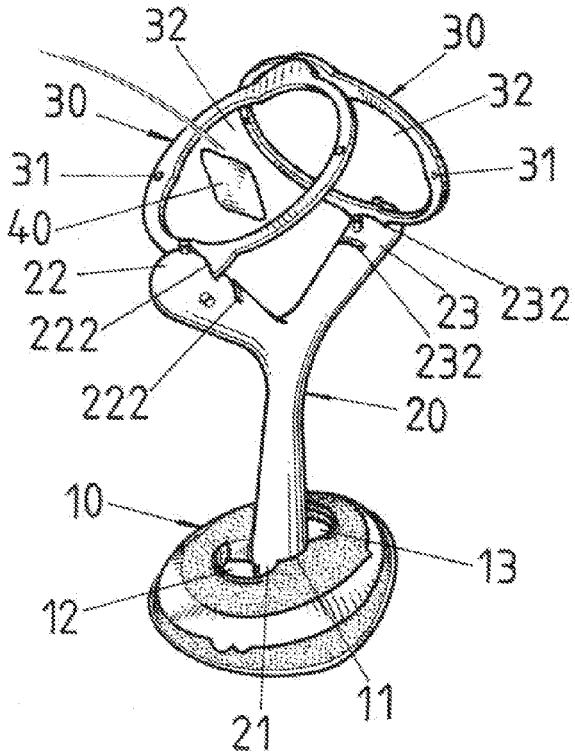
FIG. 6 shows another schematic view of the embodiment of the present invention.

The two left and right support rods 22, 23, comprising the top portion of the rod 20 and extending upward from the central supporting point thereof, are each provided with at least one clasp hook 221, 231 and at least one clasp hole 222, 232 respectively. Referring to FIG. 5, various forms of rings 30 are provided with hook holes 31, and the hook holes 31 are used to hook onto the clasp hooks 221, 231 of the left and right support rods 22, 23 respectively, Referring to FIG. 6, the peripheral edges of the rings 30 can be inserted and fixedly positioned in the clasp holes 222, 232 of the left and right support rods 22, 23 respectively. A hollow part 32 of each of the aforementioned rings 30 allows for children to throw sandbags 40, rubber bands, or other objects therethrough.

Figure 7:
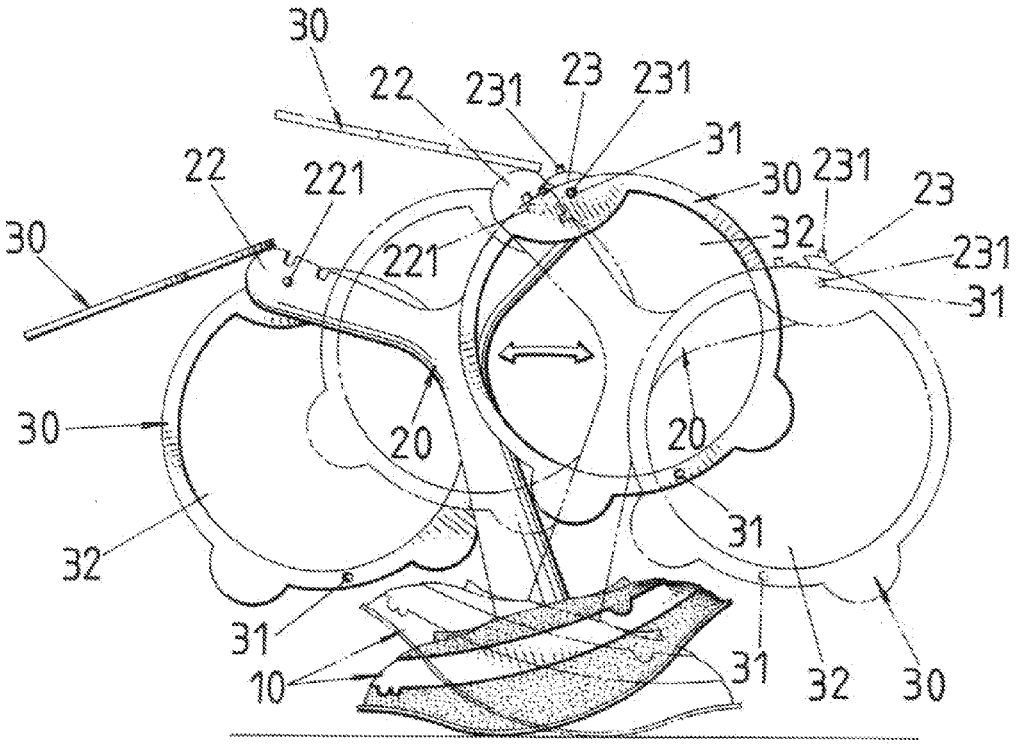
FIG. 7 shows a schematic view of of the present invention in different positions while swaying and rocking back and forth during use.

Referring to FIG. 7, when the rings 30 are hooked onto the rod 20, touching the base 10 or the rod 20 causes the base 10 to sway and rock back and forth to the left and right using the front and rear ends of the base 10 as a pivot.

Figure 8:
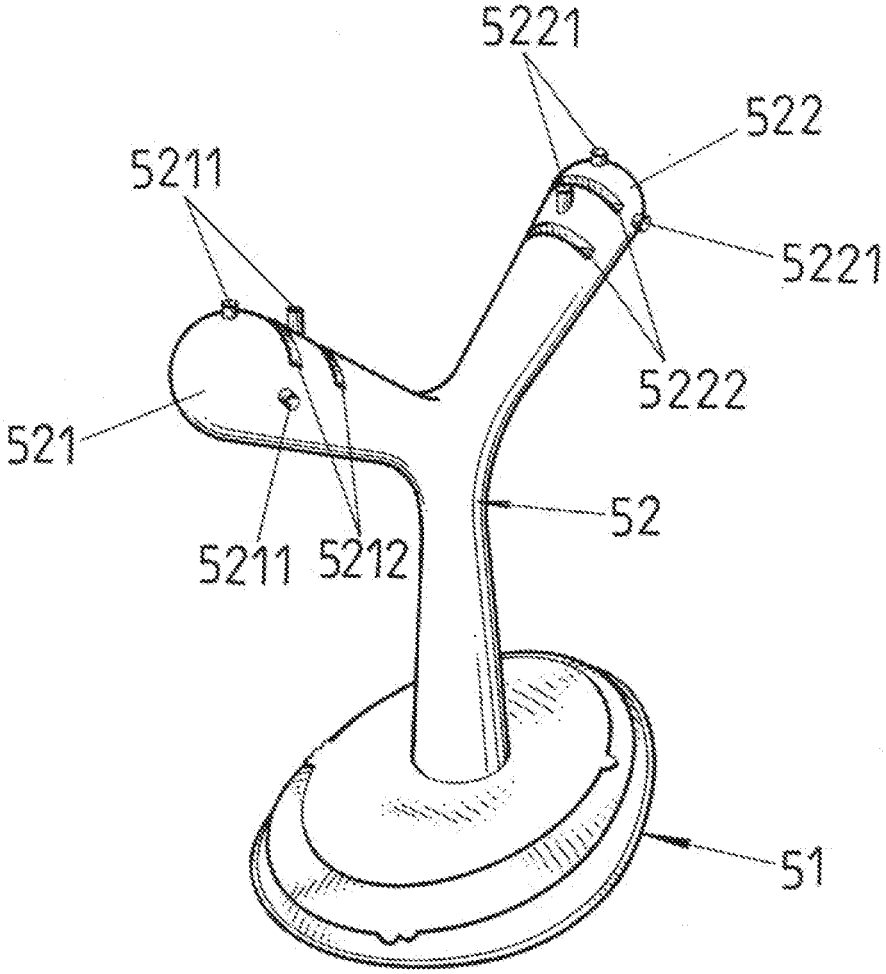
FIG. 8 shows a schematic view of another embodiment of the present invention.

Referring to FIG. 8, in another embodiment of the present invention, a base 51 of the game apparatus and a rod 52 are structured to form a single integral body, wherein the base 51 is a base that is able to sway and rock back and forth. The front and rear positions of the base 51 are lower so as to be in contact with the horizontal surface of a floor or table, whereas the left and right side positions of the base 51 are higher and off the ground, with a space between the left and right side positions and the horizontal surface of a floor or table. The rod 52 is designed to form a Y-shaped rod, with the rod 52 extending in two directions from a central supporting point thereof to form two support rods 521, 522. The support rods 521, 522, are each provided with at least one clasp hook 5211, 5221 and at least one clasp hole 5212, 5222 respectively. The clasp hooks 5211, 5221 enable the hook holes 31 of the rings 30 to be hooked and fixed thereon. The clasp holes 5212, 5222 enable the peripheral edge of each of the rings 30 to be inserted and fixed therein.

In light of the above, and in accordance with the above description of the embodiments, a multifunctional swaying throwing game apparatus of the present invention is assembled from a base that is able to sway and rock back and forth, and a Y-shaped rod for hooking rings thereon. The throwing game apparatus as described provides a multifunctional game which transcends the shortcomings of traditional game apparatus, and is clearly an innovative design.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A multifunctional swaying throwing game apparatus, comprising:

a base, the base is a base able to sway and rock back and forth, at least one clasp groove that is provided on the surface of the base, and one rod; a support rod at a bottom portion of the rod is wedged inside the clasp groove of the base;

wherein the rod is designed to form a Y-shaped rod; two support rods extend from the upper portion of the Y-shaped rod, and each of the support rods are provided with at least one clasp hook and at least one clasp hole; one or more clasp hook rings comprising clasp hook holes; the clasp hook holes on the one or more clasp hook rings corresponding to the at least one clasp hook and hook onto the at least one clasp hook, and the peripheral edge of each of the one or more rings designed to insert and be fixedly positioned inside the at least one clasp hole of the two support rods.

* * * * *